US010435649B2

(12) United States Patent
Job et al.

(10) Patent No.: US 10,435,649 B2
(45) Date of Patent: Oct. 8, 2019

(54) WASHING OR CLEANING AGENT WITH ELECTROCHEMICALLY ACTIVATABLE MEDIATOR COMPOUND

(71) Applicant: Henkel AG & Co. KGaA, Duesseldorf (DE)

(72) Inventors: Mareile Job, Leverkusen (DE); Peter Schmiedel, Duesseldorf (DE); Erik Brueckner, Hilden (DE); Guido Grundmeier, Wuerzburg (DE); Markus Voigt, Paderborn (DE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 14/166,905

(22) Filed: Jan. 29, 2014

(65) Prior Publication Data

US 2014/0143959 A1 May 29, 2014

Related U.S. Application Data

(63) Continuation of application No. PCT/EP2012/064491, filed on Jul. 24, 2012.

(30) Foreign Application Priority Data

Jul. 29, 2011 (DE) ..... 10 2011 080 099

(51) Int. Cl.

| | |
|---|---|
| ***B08B 9/20*** | (2006.01) |
| ***C11D 3/28*** | (2006.01) |
| ***C11D 3/39*** | (2006.01) |
| ***C11D 11/00*** | (2006.01) |
| ***C11D 3/395*** | (2006.01) |
| ***C11D 3/30*** | (2006.01) |

(52) U.S. Cl.

CPC ..... *C11D 3/3951* (2013.01); *C11D 3/28* (2013.01); *C11D 3/30* (2013.01); *C11D 3/3955* (2013.01); *C11D 3/3956* (2013.01); *C11D 11/007* (2013.01)

(58) Field of Classification Search

None

See application file for complete search history.

(56) References Cited

U.S. PATENT DOCUMENTS

| | | | | |
|---|---|---|---|---|
| 4,319,973 | A * | 3/1982 | Porta | C02F 1/4672 205/770 |
| 4,772,412 | A * | 9/1988 | Green | C01B 15/126 252/186.38 |
| 5,827,808 | A * | 10/1998 | Appleby | C11D 3/0021 510/220 |
| 6,187,170 | B1 * | 2/2001 | Hampp | C25B 3/02 204/242 |
| 6,830,591 | B1 * | 12/2004 | Wang | D06L 3/021 510/276 |
| 2002/0166177 | A1 * | 11/2002 | Hamand | D06F 39/02 8/158 |
| 2003/0188976 | A1 * | 10/2003 | Culvey | C02F 1/4618 205/743 |
| 2005/0028291 | A1 * | 2/2005 | Bechtold | D06P 5/132 8/115.51 |
| 2005/0224339 | A1 * | 10/2005 | Wright | D06F 35/004 204/253 |
| 2005/0245414 | A1 * | 11/2005 | Baldridge | C11D 3/384 510/276 |
| 2006/0096618 | A1 * | 5/2006 | Price | A47L 15/0015 134/25.2 |
| 2006/0288743 | A1 * | 12/2006 | van Kralingen | C02F 1/469 68/147 |
| 2010/0006122 | A1 * | 1/2010 | Brown | A47L 15/0002 134/25.2 |
| 2010/0181208 | A1 * | 7/2010 | Denison | A47L 15/42 205/687 |
| 2011/0237484 | A1 * | 9/2011 | Griesbach | C08B 15/02 510/309 |
| 2013/0056364 | A1 * | 3/2013 | Stecker | A47L 15/0002 205/466 |

FOREIGN PATENT DOCUMENTS

| | | | |
|---|---|---|---|
| DE | 2412837 | | 10/1974 |
| DE | 19843571 | A1 * | 3/2000 |
| EP | 0146184 | A2 | 6/1985 |
| WO | 2009/106406 | A1 | 9/2009 |
| WO | 2010/135499 | A1 | 11/2010 |

OTHER PUBLICATIONS

PCT International Search Report (PCT/EP2012/064491) dated Sep. 25, 2012.

* cited by examiner

*Primary Examiner* — Lorna M Douyon

(74) *Attorney, Agent, or Firm* — Thomas G. Krivulka

(57) ABSTRACT

The cleaning performance of washing and cleaning agents, in particular with respect to bleachable stains, was to be intensified without resulting in damage, in the context of use, to the textile treated therewith. This was achieved substantially by employing a bleaching-active species generated electrolytically from an organic mediator compound using a redox reaction.

5 Claims, No Drawings

WASHING OR CLEANING AGENT WITH ELECTROCHEMICALLY ACTIVATABLE MEDIATOR COMPOUND

FIELD OF THE INVENTION

The present invention generally relates to the use of specific organic mediator compounds to intensify the cleaning performance of washing and cleaning agents with respect to stains; to washing or cleaning methods employing bleaching-active species generated from the mediator compound; and to washing and cleaning agents that contain the mediator compound.

BACKGROUND OF THE INVENTION

Inorganic peroxygen compounds, in particular hydrogen peroxide and solid peroxygen compounds that dissolve in water with release of hydrogen peroxide, such as sodium perborate and sodium carbonate perhydrate, have been used for some time as oxidizing agents for disinfection and bleaching purposes. The oxidizing effect of these substances in dilute solutions depends greatly on temperature; sufficiently rapid bleaching of stained textiles in alkaline bleaching baths is obtained, for example, with $H_2O_2$ or perborate only at temperatures above approximately 80° C. At lower temperatures, the oxidizing effect of the inorganic peroxygen compounds can be improved by the addition of so-called "bleach activators," which are capable of supplying peroxocarboxylic acids under the above-discussed perhydrolysis conditions and have become known in the literature for numerous proposals, chiefly from the substance classes of the N- or O-acyl compounds, for example reactive esters, polyacylated alkylenediamines, in particular N,N,N',N'-tetraacetylethylenediamine (TAED), acylated glycourils, in particular tetraacetylglycouril, N-acylated hydantoins, hydrazides, triazoles, hydrotriazines, urazoles, diketopiperazines, sulfurylamides, and cyanurates, also carboxylic acid anhydrides, in particular phthalic acid anhydride, carboxylic acid esters, in particular sodium nonanoyl oxybenzenesulfonate (NOBS), sodium isononanoyl oxybenzenesulfonate, O-acylated sugar derivatives such as pentaacetyl glucose, and N-acylated lactams, such as N-benzoylcaprolactam. The addition of these substances allows the bleaching effect of aqueous peroxide baths to be increased sufficiently that the effects that occur at temperatures around 60° C. are already substantially the same as with the peroxide bath alone at 95° C.

In the context of efforts toward energy-saving washing and bleaching methods in recent years, utilization temperatures that are even appreciably below 60° C., in particular below 45° C., down to cold-water temperature, have also become increasingly important.

As a rule, the effect of the hitherto known activator compounds decreases perceptibly at these low temperatures. There has therefore been no shortage of efforts to develop more-effective activators for this temperature range. There have also been various proposals to use transition metal compounds, in particular transition metal complexes, to enhance the oxidizing power of peroxygen compounds or also of atmospheric oxygen in washing and cleaning agents. Among the transition metal compounds proposed for this purpose are, for example, salen complexes of manganese, iron, cobalt, ruthenium, or molybdenum, carbonyl complexes of manganese, iron, cobalt, ruthenium, or molybdenum, complexes of manganese, iron, cobalt, ruthenium, molybdenum, titanium, vanadium, and copper with nitrogen-containing tripod ligands, and manganese complexes with polyazacycloalkane ligands, such as TACN. A disadvantage of such metal complexes, however, is either that they possess in part a bleaching performance that is insufficient especially at lower temperature, or, if they have sufficient bleaching performance, that undesired damage can occur to the colors of the material to be washed or cleaned, and in some cases even to the material itself, for example the textile fibers.

It has now been found, surprisingly, that bleaching-active species that exhibit an outstanding bleach-intensifying effect, and that intensify the cleaning performance of washing and cleaning agents in particular with respect to bleachable stains, can be generated from organic mediator compounds by electrolysis.

A subject of the invention is accordingly the use of bleaching-active species, generated electrolytically from organic mediator compounds using a redox reaction, to intensify the cleaning performance of washing and cleaning agents, in particular with respect to bleachable and/or protein-containing stains, in an aqueous, in particular a surfactant-containing bath.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A washing or cleaning agent, characterized in that it contains an organic mediator compound that can be converted, by means of electrolysis using a redox reaction, into a bleaching-active species.

Use of a bleaching-active species, generated electrolytically from an organic mediator compound using a redox reaction, to intensify the cleaning performance of washing and cleaning agents in an aqueous, in particular surfactant-containing bath.

A method for washing textiles or for cleaning hard surfaces, in particular for automatic cleaning of dishes, employing a bleaching-active species generated electrolytically from an organic mediator compound using a redox reaction.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Mediator compounds usable according to the present invention are organic compounds that can be electrolytically oxidized or reduced in an aqueous system, preferably in aqueous solution. These are preferably aliphatic, cycloaliphatic, aromatic, or araliphatic compounds optionally containing heteroatoms, which comprise an N—OH, N—OR group, a nitroxyl radical N—O., and/or an N—$O^-$ group having an $M^+$ or ½ $M^{2+}$ counter cation, where R is an alkyl group having preferably 1 to 4 carbon atoms and M is hydrogen, an alkali metal, or an alkaline earth metal, among which are included, for example, hydroxamic acids such as N-hydroxyphthalimide, N-hydroxyheteroaromatics such as 1-hydroxyindole, 1-hydroxybenzimidazole, and 1-hydroxy-benzotriazole, radicals of sterically hindered N-hydroxy compounds such as (2,2,6,6-tetramethylpiperidin-1-yl)oxyl, and oximidoketones such as violuric acid and N,N'-dimethylvioluric acid, which can be employed alone or in mixtures of at least two such compounds.

The bleaching-active species can easily be manufactured by subjecting an aqueous system that contains the mediator compound to an electrical potential difference applied between at least two electrodes, so that the mediator compound accepts or, preferably, gives up an electron. Without wishing to be tied to this theory, it is conceivable that the radical species thereby generated travels to the dirt along with the aqueous bath and transfers an electron to (or preferably removes an electron from) the stain, with the result that a less-colored and/or more readily water-soluble and/or water-dispersible material is ultimately produced from the stain. The potential difference is preferably 0.2 V to 5 V, in particular 1 V to 3 V. The mediator compound is preferably reconstituted from the bleaching-active species by reaction with the stain, so that a reversible redox system is present. It is possible for the bath containing the mediator compound to be electrolyzed continuously or once or repeatedly for specific periods of time, in particular 10 minutes, 20 minutes, 30 minutes, 40 minutes, 50 minutes, or 60 minutes. The bleaching-active species can also be generated by the fact that, in particular when a usual bleach dispensing apparatus is used, the mediator compound passes through an electrolysis apparatus before admission into the chamber of a washing machine or automatic dishwasher, in particular flows in aqueous solution or as a slurry through an electrolysis cell, which can be mounted in the inflow conduit inside or outside the machine. Alternatively, it is also possible to allow other active agents, for example enzymes, to perform their function in uninfluenced fashion at the beginning of the method, and only later to start the bleaching action by switching on the electrolysis apparatus.

In a preferred embodiment of the invention, the electrolysis apparatus is installed inside a washing machine or automatic dishwasher in the water-filled region of the washing or cleaning space, in the case of a drum-type washing machine preferably outside the washing drum. The apparatus can be a permanently installed constituent of the washing machine or automatic dishwasher, or a separate component. In a further embodiment of the invention the electrolysis apparatus, embodied in particular as an electrolysis cell, is embodied as a separate apparatus from a washing machine or automatic dishwasher which is operated with an independent power source, for example a battery (e-bleach ball). A further embodiment according to the present invention consists in incorporating the electrolysis apparatus into an additional water circuit inside the machine. With all the embodiments, it is important that the electrodes of the electrolysis apparatus be able to come into contact with the electrolyte (the washing or cleaning bath, or the service water supplied) that contains the organic mediator compound, for example when the e-bleach ball is located in the washing drum of a washing machine during the washing process.

Further subjects of the invention are a method for washing textiles, and a method for cleaning hard surfaces, in particular for automatic cleaning of dishes, employing a bleaching-active species generated electrolytically from an organic mediator compound using a redox reaction.

It is particularly advantageous that the activity of the bleach can be easily modified by regulating the current intensity, if desired as a function of a degree of soiling or a fabric. In textile washing processes there is no damage, beyond that which occurs when agents usual on the market are employed, to the textile thereby treated.

Within the scope of the use according to the present invention and the method according to the present invention it is preferred if the concentration of the mediator compound in the aqueous washing or cleaning bath is 0.05 mmol/l to 5 mmol/l, in particular 0.1 mmol/l to 2 mmol/l. The use and the method according to the present invention are each preferably carried out at temperatures in the range from 10° C. to 95° C., especially 20° C. to 40° C. The use and the method according to the invention are each preferably carried out at pH values in the range from pH 2 to pH 12, in particular from pH 4 to pH 11.

The method or the use according to the invention can be realized particularly easily by employing a washing or cleaning agent that contains the mediator compound. Washing agents for cleaning textiles and agents for cleaning hard surfaces, in particular dishwashing agents and among them preferably those for automatic use, which contain an organic mediator compound that can be converted by means of electrolysis using a redox reaction into a bleaching-active species, alongside conventional ingredients compatible therewith, in particular a surfactant, are therefore further subjects of the invention. Although the success of the present invention is already established by the electrolytic generation of the bleaching-active species, an agent according to the present invention can also, in particular, additionally contain peroxygen-containing bleaching agent. It is particularly advantageous, however, that both bleaching agent and conventional bleach activator can be omitted, the result being that a smaller quantity of washing or cleaning agent needs to be used for each washing or cleaning cycle. In a preferred embodiment, an agent according to the present invention is therefore free of bleach and conventional bleach activator.

Preferably 0.1 wt % to 10 wt %, in particular 0.5 wt % to 5 wt %, of the mediator compound is contained in agents according to the present invention. By regulating the bleaching activity via the current intensity in the manner discussed above, a bleaching as well as a bleach-free application can be implemented, using the same agent according to the present invention, if the current intensity for the latter case is turned down to zero. The consumer therefore needs only a single washing agent for washing insensitive (as a rule, white) and sensitive (as a rule, colored) textiles.

The agents according to the present invention, which can be present as in particular powdered solids, in recompressed particle form, or as homogeneous solutions or suspensions, can in principle contain, in addition to the mediator compound to be used according to the present invention, all known ingredients that are usual in such agents. The agents according to the present invention can contain in particular builder substances, surface-active surfactants, water-miscible organic solvents, enzymes, sequestering agents, electrolytes, pH regulators, polymers having special effects, such as soil release polymers, color transfer inhibitors, anti-gray agents, crease-reducing polymeric active agents and shape-retaining polymeric active agents, bleaching agents, bleach activators, and further adjuvants such as optical brighteners, foam regulators, dyes, and scents.

The agents according to the present invention can contain one or more surfactants; anionic surfactants, nonionic surfactants, and mixtures thereof are appropriate in particular, but cationic surfactants and/or amphoteric surfactants can also be contained. Suitable nonionic surfactants are, in particular, alkyl glycosides and ethoxylation and/or propoxylation products of alkyl glycosides or of linear or branched alcohols each having 12 to 18 carbon atoms in the alkyl portion and 3 to 20, preferably 4 to 10, alkyl ether groups. Also usable are corresponding ethoxylation and/or propoxylation products of N-alkylamines, of vicinal diols, of fatty acid esters and of fatty acid amides that correspond, in terms of the alkyl portion, to the aforesaid long-chain alcohol derivatives, and of alkylphenols having 5 to 12 carbon atoms in the alkyl residue.

Suitable anionic surfactants are, in particular, soaps, and those containing sulfate or sulfonate groups having preferably alkali ions as cations. Usable soaps are preferably the alkali salts of saturated or unsaturated fatty acids having 12 to 18 carbon atoms. Such fatty acids can also be used in incompletely neutralized form. Included among the usable surfactants of the sulfate type are the salts of sulfuric acid semiesters of fatty alcohols having 12 to 18 carbon atoms, and sulfatization products of the aforesaid nonionic surfactants having a low degree of ethoxylation. Included among the usable surfactants of the sulfonate type are linear alkylbenzenesulfonates having 9 to 14 carbon atoms in the alkyl portion, alkanesulfonates having 12 to 18 carbon atoms, and olefinsulfonates having 12 to 18 carbon atoms that are produced upon reaction of corresponding monoolefins with sulfur trioxide, as well as alpha-sulfofatty acid esters that are produced upon sulfonation of fatty acid methyl or ethyl esters.

Surfactants of this kind are contained in the cleaning or washing agents according to the present invention in quantitative proportions from preferably 5 wt % to 50 wt %, in particular from 8 wt % to 30 wt %, while the disinfection agents according to the present invention, as well as cleaning agents according to the present invention, preferably contain 0.1 wt % to 20 wt %, in particular 0.2 wt % to 5 wt % surfactants.

The agents according to the present invention, especially when they are ones provided for the treatment of textiles, can contain as cationic active substances having a textile-softening effect, in particular, one or more of the cationic textile-softening substances of the general formulas X, XI, or XII:

(X)

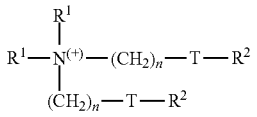

(XI)

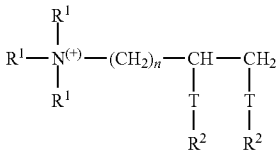

(XII)

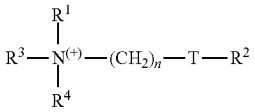

in which each group $R^1$ is selected mutually independently from $C_{1-6}$ alkyl, alkenyl, or hydroxyalkyl groups; each group $R^2$ is selected mutually independently from $C_{8-28}$ alkyl or alkenyl groups; $R^3=R^1$ or $(CH_2)_n$-T-$R^2$; $R^4=R^1$ or $R^2$ or $(CH_2)_n$-T-$R^2$; T=—$CH_2$—, —O—, —CO—, or —CO—O—, and n is an integer from 0 to 5. The cationic surfactants comprise usual anions of a kind and number necessary for charge compensation; these can be selected not only from, for example, halides but also from anionic surfactants. In preferred embodiments of the present invention, hydroxyalkyltrialkylammonium compounds, in particular $C_{12-18}$ alkyl(hydroxyethyl)dimethylammonium compounds, and preferably halides thereof, in particular chlorides, are used as cationic surfactants. An agent according to the present invention preferably contains 0.5 wt %, to 25 wt %, in particular 1 wt % to 15 wt % cationic surfactant.

An agent according to the present invention preferably contains at least one water-soluble and/or water-insoluble, organic and/or inorganic builder. Included among the water-soluble organic builder substances are polycarboxylic acids, in particular citric acid and sugar acids, monomeric and polymeric aminopolycarboxylic acids, in particular methylglycinediacetic acid, nitrilotriacetic acid, and ethylenediaminetetraacetic acid, as well as polyaspartic acid, polyphosphonic acids, in particular aminotris (methylenephosphonic acid), ethylenediaminetetrakis (methylenephosphonic acid), and 1-hydroxyethane-1,1-diphosphonic acid, polymeric hydroxy compounds such as dextrin, as well as polymeric (poly)carboxylic acids, in particular polycarboxylates accessible by the oxidation of polysaccharides such as dextrins, and/or polymeric acrylic acids, methacrylic acids, maleic acids, and mixed polymers thereof, which can also contain, polymerized into them, small proportions of polymerizable substances having no carboxylic-acid functionality. The relative molecular weight of the homopolymers of unsaturated carboxylic acids is generally between 5000 and 200,000, that of the copolymers between 2000 and 200,000, preferably 50,000 to 120,000, based in each case on free acid. A particularly preferred acrylic acid/maleic acid copolymer has a relative molecular weight from 50,000 to 100,000. Suitable (although less preferred) compounds of this class are copolymers of acrylic acid or methacrylic acid with vinyl ethers, such as vinyl methyl ethers, vinyl esters, ethylene, propylene, and styrene, in which the proportion of acid is equal to at least 50 wt %. It is also possible to use, as water-soluble organic builder substances, terpolymers that contain two unsaturated acids and/or salts thereof as monomers and, as a third monomer, vinyl alcohol and/or a vinyl alcohol derivative or a carbohydrate. The first acid monomer respectively salt thereof is derived from an ethylenically monounsaturated $C_3$ to $C_8$ carboxylic acid and preferably from a $C_3$ to $C_4$ monocarboxylic acid, in particular from (meth)acrylic acid. The second acid monomer respectively salt thereof can be a derivative of a $C_4$ to $C_8$ dicarboxylic acid, maleic acid being particularly preferred, and/or a derivative of an allylsulfonic acid that is substituted in the 2-position with an alkyl or aryl residue. Such polymers generally have a relative molecular weight between 1000 and 200,000. Further preferred copolymers are those that comprise, as monomers, acrolein and acrylic acid/acrylic acid salts, respectively vinyl acetate. Especially for the manufacture of liquid agents, the organic builder substances can be used in the form of aqueous solutions, preferably in the form of 30- to 50-weight-percent aqueous solutions. All the aforesaid acids are used as a rule in the form of their water-soluble salts, in particular their alkali salts.

Organic builder substances of this kind can be contained, if desired, in quantities of up to 40 wt %, in particular up to 25 wt %, and preferably from 1 wt % to 8 wt %. Quantities close to the aforesaid upper limit are used preferably in pasty or liquid, in particular water-containing, agents according to the present invention.

Suitable water-soluble inorganic builder materials are, in particular, polymeric alkali phosphates, which can be present in the form of their alkaline, neutral, or acidic sodium or potassium salts. Examples thereof are tetrasodium diphosphate, disodium dihydro gen diphosphate, pentasodium triphosphate, so-called sodium hexametaphosphate, and the corresponding potassium salts respectively mixtures of sodium and potassium salts. Crystalline or amorphous alkali aluminosilicates are used in particular as water-insoluble, water-dispersible inorganic builder materials, in quantities of up to 50 wt %, preferably not above 40 wt %, and in liquid agents in particular from 1 wt % to 5 wt %. Among these, the crystalline sodium aluminosilicates of washing-agent quality, in particular zeolite A, P, and optionally X, are preferred. Quantities close to the aforesaid upper limit are used preferably in solid, particulate agents. Suitable aluminosilicates exhibit, in particular, no particles having a particle size greater than 30 μm, and preferably are made up of at least 80 wt % particles having a size less than 10 μm. Their calcium binding capability, which can be determined as indicated in German Patent DE 24 12 837, is generally in the range from 100 to 200 mg CaO per gram.

Suitable substitutes respectively partial substitutes for the aforesaid aluminosilicate are crystalline alkali silicates, which can be present alone or mixed with amorphous silicates. The alkali silicates usable in the agents according to the present invention as builders have preferably a molar ratio of alkali oxide to $SiO_2$ below 0.95, in particular from 1:1.1 to 1:12, and can be present in amorphous or crystalline fashion. Preferred alkali silicates are the sodium silicates, in particular the amorphous sodium silicates, having a $Na_2O$:$SiO_2$ molar ratio from 1:2 to 1:2.8. Crystalline sheet silicates of the general formula $Na_2Si_xO_{2x+1}.y\ H_2O$, in which x, the so-called modulus, is a number from 1.9 to 4 and y is a number from 0 to 20, and preferred values for x are 2, 3, or 4, are preferred for use as crystalline silicates, which can be present alone or in a mixture with amorphous silicates. Preferred crystalline sheet silicates are those in which x in the general formula recited assumes the values 2 or 3. In particular, both β- and δ-sodium disilicates ($Na_2Si_2O_5.y\ H_2O$) are preferred. Practically anhydrous crystalline alkali silicates manufactured from amorphous alkali silicates and having the aforesaid general formula, in which x denotes a number from 1.9 to 2.1, can also be used in agents according to the present invention. In a further preferred embodiment of agents according to the present invention, a crystalline sodium sheet silicate having a modulus from 2 to 3 can be used, such as the one that can be manufactured from sand and soda. Crystalline sodium silicates having a modulus in the range from 1.9 to 3.5 are used in a further preferred embodiment of agents according to the present invention. In a preferred embodiment of agents according to the present invention, a granular compound of alkali silicate and alkali carbonate is used, such as the one commercially obtainable e.g. under the name Nabion® 15. If alkali aluminosilicate, in particular zeolite, is also present as an additional builder substance, the weight ratio of aluminosilicate to silicate, based in each case on anhydrous active substances, is preferably 1:10 to 10:1. In agents that contain both amorphous and crystalline alkali silicates, the weight ratio of amorphous alkali silicate to crystalline alkali silicate is preferably 1:2 to 2:1, and in particular 1:1 to 2:1.

Builder substances are contained in the washing agents according to the present invention preferably in quantities of up to 60 wt %, in particular from 5 wt % to 40 wt %.

In a preferred embodiment of the invention, an agent according to the present invention comprises a water-soluble builder block. The use of the term "builder block" here is intended to express the fact that the agents contain no builder substances other than those that are water-soluble, i.e. all the builder substances contained in the agent are combined into the "block" thus characterized; an exception is made, at most, for substances that may be contained in commercially usual fashion in small quantities, as contaminants respectively as stabilizing additives, in the other ingredients of the agents. The term "water-soluble" is to be understood in this context to mean that the builder block dissolves without residue, under usual conditions, at the concentration resulting from the utilization quantity of the agent containing it. Preferably at least 15 wt % and up to 55 wt %, in particular 25 wt % to 50 wt %, water-soluble builder block is contained in the agents according to the present invention. This is preferably made up of the following components:

a) 5 wt % to 35 wt % citric acid, alkali citrate, and/or alkali carbonate, which can also be replaced at least in part by alkali hydrogen carbonate;
b) up to 10 wt % alkali silicate having a modulus in the range from 1.8 to 2.5;
c) up to 2 wt % phosphonic acid and/or alkali phosphonate;
d) up to 50 wt % alkali phosphate; and
e) up to 10 wt % polymeric polycarboxylate, where the quantitative indications refer to the total washing or cleaning agent. This also applies to all quantitative indications hereinafter unless expressly indicated otherwise.

In a preferred embodiment of agents according to the present invention, the water-soluble builder block contains at least two of components b), c), d), and e) in quantities greater than 0 wt %.

With regard to component a), 15 wt % to 25 wt % alkali carbonate, which can be replaced at least in part by alkali hydrogen carbonate, and up to 5 wt %, in particular 0.5 wt % to 2.5 wt % citric acid and/or alkali citrate, are contained in a preferred embodiment of agents according to the present invention. In an alternative embodiment of agents according to the present invention, 5 wt % to 25 wt %, in particular 5 wt % to 15 wt % citric acid and/or alkali citrate and up to 5 wt %, in particular 1 wt % to 5 wt % alkali carbonate, which can be replaced at least in part by alkali hydrogen carbonate, are contained. If both alkali carbonate and alkali hydrogen carbonate are present, component a) comprises alkali carbonate and alkali hydrogen carbonate preferably at a weight ratio from 10:1 to 1:1.

With regard to component b), 1 wt % to 5 wt % alkali silicate having a modulus in the range from 1.8 to 2.5 is contained in a preferred embodiment of agents according to the present invention.

With regard to component c), 0.05 wt % to 1 wt % phosphonic acid and/or alkali phosphonate is contained in a preferred embodiment of agents according to the present invention. "Phosphonic acids" are also understood in this context as optionally substituted alkylphosphonic acids that can also comprise several phosphonic-acid groupings (so-called polyphosphonic acids). They are preferably selected from the hydroxy- and/or aminoalkylphosphonic acids and/or alkali salts thereof such as, for example, dimethylaminomethanediphosphonic acid, 3-aminopropane-1-hydroxy-1,1-diphosphonic acid, 1-amino-1-phenylmethanediphosphonic acid, 1-hydroxyethane-1,1-diphosphonic acid, amino-tris(methylenephosphonic acid), N,N,N',N'-ethylenediaminetetrakis(methylenephosphonic) acid, and acylated derivatives of phosphoric acid, which can also be used in any desired mixtures.

With regard to component d), 15 wt % to 35 wt % alkali phosphate, in particular trisodium polyphosphate, is contained in a preferred embodiment of agents according to the present invention. "Alkali phosphate" is the summary designation for the alkali-metal (in particular sodium and potassium) salts of the various phosphoric acids, in which context a distinction can be made between metaphosphoric acids $(HPO_3)_n$ and orthophosphoric acid $H_3PO_4$, in addition to higher-molecular-weight representatives. The phosphates embody a number of advantages: they act as alkali carriers, prevent lime deposits on machine parts and lime encrustations in fabrics, and furthermore contribute to cleaning performance. Sodium dihydrogen phosphate, $NaH_2PO_4$, exists as the dihydrate (density 1.91 $gcm^{-3}$, melting point 60°) and as the monohydrate (density 2.04 $gcm^{-3}$). Both salts are white powders, very easily soluble in water, that lose their water of crystallization upon heating; they transition at 200° C. into the weakly acidic diphosphate (disodium hydrogendiphosphate, $Na_2H_2P_2O_7$), and at higher temperature into sodium trimetaphosphate ($Na_3P_3O_9$) and Maddrell's salt. $NaH_2PO_4$ reacts in acidic fashion; it is created when phosphoric acid is adjusted with sodium hydroxide to a pH of 4.5 and the mash is spray-dried. Potassium dihydrogen phosphate (primary or monobasic potassium phosphate, potassium diphosphate, KDP), $KH_2PO_4$, is a white salt of density 2.33 $gcm^{-3}$, has a melting point of 253° (decomposing to form $(KPO_3)_x$, potassium polyphosphate), and is easily soluble in water. Disodium hydrogen phosphate (secondary sodium phosphate), $Na_2HPO_4$, is a colorless, very easily water-soluble crystalline salt. It exists anhydrously and with 2 mol (density 2.066 $gcm^{-3}$, water lost at 95°), 7 mol (density 1.68 $gcm^{-3}$, melting point 48° with loss of 5 $H_2O$), and 12 mol of water (density 1.52 $gcm^{-3}$, melting point 35° with loss of 5 $H_2O$); it becomes anhydrous at 100°, and when further heated transitions into the diphosphate $Na_4P_2O_7$. Disodium hydrogen phosphate is produced by neutralizing phosphoric acid with a soda solution using phenolphthalein as indicator. Dipotassium hydrogen phosphate (secondary or dibasic potassium phosphate), $K_2HPO_4$, is an amorphous white salt that is easily soluble in water. Trisodium phosphate (tertiary sodium phosphate), $Na_3PO_4$, exists as colorless crystals that as the dodecahydrate have a density of 1.62 $gcm^{-3}$ and a melting point of 73 to 76° C. (decomposition), as the decahydrate (corresponding to 19 to 20% $P_2O_5$) a melting point of 100° C., and in anhydrous form (corresponding to 39 to 40% $P_2O_5$) a density of 2.536 $gcm^{-3}$. Trisodium phosphate is easily soluble in water with an alkaline reaction, and is produced by evaporating a solution of exactly 1 mol disodium phosphate and 1 mol NaOH. Tripotassium phosphate (tertiary or tribasic potassium phosphate), $K_3PO_4$, is a white, deliquescent, granular powder with a density of 2.56 $gcm^{-3}$, has a melting point of 1340° C., and is easily soluble in water with an alkaline reaction. It is produced, for example, upon heating of basic slag with carbon and potassium sulfate. Despite the higher price, the more easily soluble and therefore highly active potassium phosphates are greatly preferred over corresponding sodium compounds in the cleaning-agent industry. Tetrasodium diphosphate (sodium pyrophosphate), $Na_4P_2O_7$, exists in anhydrous form (density 2.534 $gcm^{-3}$, melting point 988°, also indicated as 880°) and as the decahydrate (density 1.815 to 1.836 $gcm^{-3}$, melting point 94° with loss of water). Both substances are colorless crystals that are soluble in water with an alkaline reaction. $Na_4P_2O_7$ is created when disodium phosphate is heated to >200°, or by reacting phosphoric acid with soda at the stoichiometric ratio and dewatering the solution by spraying. The decahydrate complexes heavy-metal salts and hardness constituents, and therefore decreases water hardness. Potassium diphosphate (potassium pyrophosphate), $K_4P_2O_7$, exists in the form of the trihydrate and represents a colorless, hygroscopic powder with a density of 2.33 $gcm^{-3}$ that is soluble in water, the pH of a 1% solution being 10.4 at 25°. Condensation of $NaH_2PO_4$ or $KH_2PO_4$ yields higher-molecular-weight sodium and potassium phosphates, within which a distinction can be made between cyclic representatives (the sodium or potassium metaphosphates) and chain types (the sodium or potassium polyphosphates). For the latter in particular, a number of designations are in use: fused or thermal phosphates, Graham salt, Kurrol's salt, and Maddrell's salt. All the higher sodium and potassium phosphates are together referred to as "condensed" phosphates. The industrially important pentasodium triphosphate $Na_5P_3O_{10}$ (sodium tripolyphosphate) is a white, water-soluble, non-hygroscopic salt, crystallizing anhydrously or with 6 $H_2O$, of the general formula NaO—[P(O)(ONa)—O]$_n$—Na, where n=3. Approximately 17 g of the salt containing no water of crystallization dissolves in 100 g of water at room temperature, approx. 20 g at 60° C., and approx. 32 g at 100°; after the solution is heated to 100° for two hours, approx. 8% orthophosphate and 15% disphosphate are produced by hydrolysis. In the production of pentasodium triphosphate, phosphoric acid is reacted with a soda solution or sodium hydroxide at the stoichiometric ratio, and the solution is dewatered by spraying. Like Graham salt and sodium diphosphate, pentasodium triphosphate dissolves many insoluble metal compounds (including lime soaps). Pentapotassium triphosphate $K_5P_3O_{10}$ (potassium tripolyphosphate) is marketed, for example, in the form of a 50-wt % solution (>23% $P_2O_5$, 25% $K_2O$). Potassium polyphosphates are widely used in the washing- and cleaning-agent industry. Sodium potassium tripolyphosphates also exist and are likewise usable in the context of the present invention. They are produced, for example, when sodium trimetaphosphate is hydrolyzed with KOH:

$$(NaPO_3)_3+2KOH \rightarrow Na_3K_2P_3O_{10}+H_2O$$

These are usable according to the present invention in just the same way as sodium tripolyphosphate, potassium tripolyphosphate, or mixtures of the two; mixtures of sodium tripolyphosphate and sodium potassium tripolyphosphate, or mixtures of potassium tripolyphosphate and sodium potassium tripolyphosphate, or mixtures of sodium tripolyphosphate and potassium tripolyphosphate and sodium potassium tripolyphosphate are also usable according to the present invention.

With regard to component e), 1.5 wt % to 5 wt % polymeric polycarboxylate, selected in particular from the polymerization products or copolymerization products of acrylic acid, methacrylic acid, and/or maleic acid, are contained in a preferred embodiment of agents according to the present invention. Among these, the homopolymers of acrylic acid, and among the latter in turn those having an average molar mass in the range from 5000 D to 15,000 D (PA standard), are particularly preferred.

Possibilities as enzymes usable in the agents are, in addition to the oxidases recited below, those from the class of the proteases, lipases, cutinases, amylases, pullulanases, mannanases, cellulases, hemicellulases, xylanases, and peroxidases, as well as mixtures thereof, for example proteases such as BLAP®, Optimase®, Opticlean®, Maxacal®, Maxapem®, Alcalase®, Esperase®, Savinase®, Durazym® and/or Purafect® OxP, amylases such as Termamyl®, Amylase-LT®, Maxamyl®, Duramyl® and/or Purafect® OxAm, lipases such as Lipolase®, Lipomax®, Lumafast® and/or Lipozym®, cellulases such as Celluzyme® and/or Carezyme®. Enzymatic active agents recovered from fungi or bacteria, such as *Bacillus subtilis, Bacillus licheniformis, Streptomyces griseus, Humicola lanuginosa, Humicola insolens, Pseudomonas pseudoalcaligenes*, or *Pseudomonas cepacia*, are particularly suitable. The enzymes that are optionally used can be adsorbed onto carrier substances and/or embedded into encasing substances in order to protect them from premature inactivation. They are contained in the washing, cleaning, and disinfecting agents according to the present invention preferably in quantities of up to 10 wt %, in particular from 0.2 wt % to 2 wt %, enzymes stabilized against oxidative breakdown being used with particular preference.

In a preferred embodiment of the invention, the agent contains 5 wt % to 50 wt %, in particular 8 to 30 wt % anionic and/or nonionic surfactant, up to 60 wt %, in particular 5 to 40 wt % builder substance, and 0.2 wt % to 2 wt % enzyme, selected from the proteases, lipases, cutinases, amylases, pullulanases, mannanases, cellulases, oxidases, and peroxidases as well as mixtures thereof.

Appropriate peroxygen compounds optionally contained in the agents, which nevertheless can preferably be omitted from agents provided for use in methods according to the present invention, are in particular organic peracids or peracid salts of organic acids, such as phthalimidopercaproic acid, perbenzoic acid, or salts of diperdodecanedioic acid, hydrogen peroxide, and inorganic salts that release hydrogen peroxide under washing conditions, such as perborate, percarbonate, and/or persilicate. Hydrogen peroxide can also be generated with the aid of an enzymatic system, i.e. an oxidase and its substrate. If solid peroxygen compounds are to be employed, they can be utilized in the form of powders or granulates, which can also in principle be encased in known fashion. It is particularly preferred to employ alkali percarbonate, alkali perborate monohydrate, alkali perborate tetrahydrate, or hydrogen peroxide in the form of aqueous solutions that contain 3 wt % to 10 wt % hydrogen peroxide. If desired, peroxygen compounds are present in washing or cleaning agents according to the present invention in quantities of up to 50 wt %, in particular from 5 wt % to 30 wt %.

Usual bleach activators that form peroxocarboxylic acids or peroxoimidic acids under perhydrolysis conditions, and/or usual transition metal complexes that activate bleaches, can additionally be used. The bleach activator component that is optionally present, in particular in quantities from 0.5 wt % to 6 wt %, comprises the N- or O-acyl compounds that are usually used, for example polyacylated alkylenediamines, in particular tetraacetylethylenediamine, acylated glycourils, in particular tetraacetylglycouril, N-acylated hydantoins, hydrazides, triazoles, urazoles, diketopiperazines, sulfurylamides, and cyanurates, also carboxylic acid anhydrides, in particular phthalic acid anhydride, carboxylic acid esters, in particular sodium isononanoyl phenolsulfonate, and acylated sugar derivatives, in particular pentaacetyl glucose, as well as cationic nitrile derivatives such as trimethylammonium acetonitrile salts. In order to avoid interaction with the per-compounds during storage, the bleach activators can be granulated or coated with encasing substances in known fashion; tetraacetylethylenediamine granulated with the aid of carboxymethyl cellulose and having average particles sizes from 0.01 mm to 0.8 mm, granulated 1,5-diacetyl-2,4-dioxohexahydro-1,3,5-triazine, and/or trialkylammonium acetonitrile formulated in particle form are particularly preferred. Bleach activators of this kind are contained in washing or cleaning agents preferably in quantities of up to 8 wt %, in particular from 2 wt % to 6 wt %, based in each case on the total agent.

Included among the organic solvents usable in agents according to the present invention, especially when the latter are present in liquid or pasty form, are alcohols having 1 to 4 carbon atoms, in particular methanol, ethanol, isopropanol, and tert-butanol, diols having 2 to 4 carbon atoms, in particular ethylene glycol and propylene glycol, as well as mixtures thereof, and the ethers derivable from the aforesaid compound classes. Water-miscible solvents of this kind are present in the washing or cleaning agents according to the present invention preferably in quantities not above 30 wt %, in particular from 6 to 20 wt %.

In order to establish a desired pH that does not result of itself from mixture of the other components, the agents according to the present invention can contain system-compatible and environmentally compatible acids, in particular citric acid, acetic acid, tartaric acid, malic acid, lactic acid, glycolic acid, succinic acid, glutaric acid, and/or adipic acid, but also mineral acids, in particular sulfuric acid, or bases, in particular ammonium hydroxides or alkali hydroxides. pH regulators of this kind are contained in the agents according to the present invention in quantities preferably not above 20 wt %, in particular from 1.2 to 17 wt %.

Soil-release-enabling polymers, which are often referred to as "soil release" active agents, or as "soil repellents" because of their ability to make the treated surface (for example, of the fibers) soil-repellent, are, for example, nonionic or cationic cellulose derivatives. Included among the, in particular, polyester-active soil-release-enabling polymers are copolyesters of dicarboxylic acids, for example adipic acid, phthalic acid or terephthalic acid, diols, for example ethylene glycol or propylene glycol, and polydiols, for example polyethylene glycol or polypropylene glycol. Included among the soil-release-enabling polyesters preferred for use are those compounds that are accessible formally by esterification of two monomer parts, the first monomer being a dicarboxylic acid HOOC-Ph-COOH and the second monomer being a diol $HO—(CHR^{11}—)_aOH$, which can also be present as a polymeric diol $H—(O—(CHR^{11}—)_a)_bOH$, in which Ph denotes an o-, m-, or p-phenylene residue that can carry 1 to 4 substituents selected from alkyl residues having 1 to 22 carbon atoms, sulfonic acid groups, carboxyl groups, and mixtures thereof, $R^{11}$ denotes hydrogen, an alkyl residue having 1 to 22 carbon atoms, and mixtures thereof, a is a number from 2 to 6, and b is a number from 1 to 300. Preferably, both monomer diol units $—O—(CHR^{11}—)_aO—$ and polymer diol units $—(O—(CHR^{11}—)_a)_bO—$ are present in the polyesters obtainable therefrom. The molar ratio of monomer diol units to polymer diol units is preferably 100:1 to 1:100, in particular 10:1 to 1:10. In the polymer diol units, the degree of polymerization b is preferably in the range from 4 to 200, in particular from 12 to 140. The molecular weight or average molecular weight, or the maximum of the molecular weight distribution, of preferred soil-release-enabling polyesters is in the range from 250 to 100,000, in particular from 500 to 50,000. The acid on which the Ph radical is based is selected preferably from terephthalic acid, isophthalic acid, phthalic acid, trimellitic acid, mellitic acid, the isomers of sulfophthalic acid, sulfoisophthalic acid, and sulfoterephthalic acid, and mixtures thereof. If their acid groups are not part of the ester bonds in the polymer, they are preferably present in salt form, in particular as an alkali or ammonium salt. Among these, the sodium and potassium salts are particularly preferred. If desired, instead of the HOOC-Ph-COOH monomer, small proportions—in particular no more than 10 mol % based on the proportion of Ph having the meaning indicated above—of other acids that comprise at least two carboxyl groups can be contained in the soil-release-enabling polyester. Included among these are, for example, alkylene and alkenylene dicarboxylic acids such as malonic acid, succinic acid, fumaric acid, maleic acid, glutaric acid, adipic acid, pimelic acid, suberic acid, azelaic acid, and sebacic acid. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol, and neopentyl glycol. Polyethylene glycol having an average molar weight in the range from 1000 to 6000 is particularly preferred among the polymeric diols. If desired, these polyesters can also be end-capped, alkyl groups having 1 to 22 carbon atoms and esters of monocarboxylic acids being suitable as terminal groups. It is preferred to use, alone or in combination with the cellulose derivatives, polymers of ethylene terephthalate and polyethylene oxide terephthalate in which the polyethylene glycol units have molecular weights from 750 to 5000 and the molar ratio of ethylene terephthalate to polyethylene oxide terephthalate is 50:50 to 90:10.

The color transfer inhibitors that are suitable for use in agents according to the present invention for laundering textiles include, in particular, polyvinylpyrrolidones, polyvinylimidazoles, polymeric N-oxides such as poly(vinylpyridine-N-oxide), and copolymers of vinylpyrrolidone with vinylimidazole and, if applicable, further monomers.

Because textile fabrics, in particular those made of rayon, wool, cotton, and mixtures thereof, can tend to wrinkle because the individual fibers are sensitive to bending, kinking, compression, and squeezing perpendicularly to the fiber direction, the agents according to the present invention for use in textile laundering can contain crease-prevention agents. These include, for example, synthetic products based on fatty acids, fatty acid esters, fatty acid amides, fatty acid alkylol esters, fatty acid alkylolamides, or fatty alcohols that are usually reacted with ethylene oxide, or products based on lecithin or modified phosphoric acid esters.

The purpose of anti-gray agents is to keep dirt has been detached from hard surface, and in particular from the textile fibers, suspended in the bath. Water-soluble colloids, usually organic in nature, are suitable for this, for example starch, size, gelatin, salts of ethercarboxylic or ethersulfonic acids of starch or of cellulose, or salts of acidic sulfuric-acid esters of cellulose or of starch. Water-soluble polyamides containing acid groups are also suitable for this purpose. Starch derivatives other than those recited above can also be used, for example aldehyde starches. Cellulose ethers such as carboxymethyl cellulose (sodium salt), methyl cellulose, hydroxyalkyl cellulose, and mixed ethers such as methylhydroxyethyl cellulose, methylhydroxypropyl cellulose, methylcarboxymethyl cellulose, and mixtures thereof are preferably used, for example in quantities from 0.1 to 5 wt % based on the agent.

The agents can contain optical brighteners, among them in particular derivatives of diaminostilbenedisulfonic acid or alkali metal salts thereof. Suitable, for example, are salts of 4,4'-bis(2-anilino-4-morpholino-1,3,5-triazinyl-6-amino) stilbene-2,2'-disulfonic acid, or compounds of similar structure that carry a diethanolamino group, a methylamino group, an anilino group, or a 2-methoxyethylamino group instead of the morpholino group. Brighteners of the substituted diphenylstyryl type can also be present, for example the alkali salts of 4,4'-bis(2-sulfostyryl)diphenyl, of 4,4'-bis (4-chloro-3-sulfostyryl)diphenyl, or of 4-(4-chlorostyryl)-4'-(2-sulfostyryl)diphenyl. Mixtures of the aforesaid brighteners can also be used.

For use in automatic washing or cleaning methods in particular, it can be advantageous to add usual foam inhibitors to the agents. Suitable as foam inhibitors are, for example, soaps of natural or synthetic origin that have a high proportion of $C_{18}$ to $C_{24}$ fatty acids. Suitable non-surfactant foam inhibitors are, for example, organopolysiloxanes and mixtures thereof with microfine, optionally silanated silicic acid, as well as paraffins, waxes, microcrystalline waxes, and mixtures thereof with silanated silicic acid or bis-fatty acid alkylenediamides. Mixtures of different foam inhibitors, for example those made of silicones, paraffins, or waxes, are also used with advantage. The foam inhibitors, in particular silicone- and/or paraffin-containing foam inhibitors, are preferably bound to a granular carrier substance that is soluble or dispersible in water. Mixtures of paraffins and bistearylethylenediamide are particularly preferred in this context.

Active agents to prevent the tarnishing of objects made of silver, so-called silver corrosion inhibitors, can additionally be employed in agents according to the present invention. Preferred silver corrosion protection agents are organic disulfides, divalent phenols, trivalent phenols, optionally alkyl- or aminoalkyl-substituted triazoles such as benzotriazole, and salts and/or complexes of cobalt, manganese, titanium, zirconium, hafnium, vanadium, or cerium in which the aforesaid metals are present in one of the oxidation states II, III, IV, V, or VI.

The manufacture of agents according to the present invention presents no difficulties, and can be accomplished in a manner known in principle, for example by spray drying or granulation. A method comprising an extrusion step is preferred for the manufacture of agents according to the present invention having an elevated bulk weight, in particular in the range from 650 g/l to 950 g/l. Washing, cleaning, or disinfection agents in the form of solutions containing aqueous or other usual solvents are manufactured particularly advantageously by simply mixing the ingredients, which can be introduced as substance or in solution into an automatic mixer. In a preferred embodiment of agents for, in particular, automatic cleaning of dishes, said agents are in tablet form.

Example

A 2-millimolar aqueous solution of violuric acid that had been adjusted with acetate buffer to pH 4.5 was activated at room temperature with a potential difference of 1.35 V (Ag/AgCl) using a graphite working electrode and a stainless-steel counter electrode at 15 coulomb. Cotton substrates to which standardized tea stains or a standardized blueberry juice stain had been applied were then treated for 60 minutes at 40° C. in the solution. An appreciable lightening on the fabrics was apparent.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A method for cleaning hard surfaces comprising a step wherein hard surfaces, inside an automatic dishwasher having a water-filled region of a washing or cleaning space, are treated in an aqueous surfactant-containing bath, with a bleaching-active species generated electrolytically from an organic mediator compound using a redox reaction at a bath temperature below 60° C. wherein the bath containing the mediator compound is electrolyzed for a period of time selected from the periods of time consisting of 10 minutes, 20 minutes, 30 minutes, 40 minutes, 50 minutes, and 60 minutes, wherein the organic mediator compound is selected from the group consisting of 1-hydroxyindole, 1-hydroxybenzimidazole, and 1-hydroxybenzotriazole, (2,2,6,6-tetramethylpiperidin-1-yl)oxyl, violuric acid and N,N'-dimethylviolurie acid, and mixtures thereof.

2. The method according to claim 1, wherein when a bleach dispensing apparatus is used, the mediator compound passes through an electrolysis apparatus before admission into the washing or cleaning space of the automatic dishwasher.

3. The method according to claim 2, wherein the electrolysis apparatus, comprising an electrolysis cell, is separate from the automatic dishwasher, and wherein the electrolysis apparatus is operated with an independent power source.

4. The method according to claim 1, wherein the concentration of the mediator compound in the aqueous surfactant-containing bath is 0.05 mmol/1 to 5 mmol/1.

5. The method according to claim 1, wherein the hard surfaces are treated at pH values in the range from pH 2 to pH 12.

* * * * *